US012324958B2

(12) United States Patent
Grathwol

(10) Patent No.: US 12,324,958 B2
(45) Date of Patent: Jun. 10, 2025

(54) GRIP TRAINING SYSTEM

(71) Applicant: Kyle E. Grathwol, Sandusky, OH (US)

(72) Inventor: Kyle E. Grathwol, Sandusky, OH (US)

( * ) Notice: Subject to any disclaimer, the term of this patent is extended or adjusted under 35 U.S.C. 154(b) by 114 days.

(21) Appl. No.: 18/509,551

(22) Filed: Nov. 15, 2023

(65) Prior Publication Data

US 2025/0153000 A1 May 15, 2025

(51) Int. Cl.
*A63B 23/16* (2006.01)
*A63B 21/065* (2006.01)

(52) U.S. Cl.
CPC ..... *A63B 23/16* (2013.01); *A63B 21/065* (2013.01); *A63B 2214/00* (2020.08); *A63B 2244/104* (2013.01)

(58) Field of Classification Search
CPC ..... A63B 21/065; A63B 23/12; A63B 23/16
See application file for complete search history.

(56) References Cited

U.S. PATENT DOCUMENTS 1,194,884 A * 8/1916 Sandow ..... A63B 21/4025 482/124
5,306,222 A * 4/1994 Wilkinson ..... A63B 23/03508 482/121
6,168,556 B1 1/2001 Saavedra
6,287,242 B1 * 9/2001 Fray ..... A63B 21/4015 482/121
6,458,036 B1 10/2002 Gutierrez
6,544,148 B1 * 4/2003 Loew ..... A63B 5/20 482/82
7,628,742 B2 * 12/2009 Weaver ..... A63B 21/4025 482/125
7,662,073 B1 2/2010 Baldwin
8,393,015 B2 3/2013 Jones
9,649,243 B2 5/2017 Johnson et al.
11,331,529 B1 * 5/2022 Cranke ..... A63B 21/4021
11,617,912 B1 * 4/2023 Fleischman ..... A63B 21/065 482/50
2006/0105892 A1 * 5/2006 Wilson ..... A63B 21/0552 482/121
2012/0322626 A1 12/2012 Meimaroglou
2016/0067136 A1 * 3/2016 Raghavan ..... A61B 5/225 601/40
2017/0266477 A1 * 9/2017 Cordero ..... A63B 71/0686
2018/0104539 A1 * 4/2018 Carpinelli ..... A63B 21/4039
2018/0117381 A1 * 5/2018 Ismail ..... A63B 21/0552

FOREIGN PATENT DOCUMENTS

RU 104079 U1 5/2011
WO 202220317 A1 1/2022

* cited by examiner

*Primary Examiner* — Zachary T Moore
(74) *Attorney, Agent, or Firm* — Vorys, Sater, Seymour & Pease LLP; Rex W. Miller, II; Graham Douglas Christian

(57) ABSTRACT

A grip training system includes a lapel section having a collar section and an attachment section with at least one attachment point for connecting to exercise equipment, and a sleeve section having a closed end and an open end, wherein the closed end of the sleeve section includes at least one attachment point for connecting to exercise equipment, and wherein the sleeve section further has an insert disposed between the closed end and the open end configured to maintain the open end in an open configuration to be gripped by a user.

11 Claims, 11 Drawing Sheets

GRIP TRAINING SYSTEM

TECHNICAL FIELD

The present disclosure relates to exercise equipment, and more particularly to systems for training grip strength.

BACKGROUND

Various systems and equipment have been developed for improving grip strength for various activities, and athletes of various sports often desire a stronger grip for better performance in their chosen activity. There are numerous devices on the market to help achieve a stronger grip. For example, there are the conventional spring-hinged hand gripper, spring-loaded devices that slide over your fingertips that work the grip, rubber balls, and similar devises. These conventional spring hinged grips, for example, focus the load on the forearms and hands. This type of training may be useful in some aspects, but falls short when attempting to train grip strength for grappling sports.

As another example, some martial arts athletes have been known to place a gi jacket over a pullup bar longitudinally and do pullups gripping the gi lapels. This method falls short because most people cannot do that many pullups. The weight involved with the training cannot be controlled as it is always the athlete's bodyweight. In addition, a pullup motion is not an accurate re-creation of the training environment. Similarly, other conventional workout attachments for resistance-based workout equipment are rigid and fail to mimic the grips used in grappling sports. For example, traditional lat pulldown or row attachments are made of metal. As users apply work to these attachments through a range of motion, the relative positioning of the users hands remains constant.

In light of these deficiencies, there remains a need for systems to more accurately recreate the environment of martial arts sports in order to train and improve the grip strength and techniques used in these activities.

SUMMARY

Presently disclosed is a grip training system. In an embodiment, the grip training system includes a lapel section having a collar section and an attachment section with at least one attachment point for connecting to exercise equipment, and a sleeve section having a closed end and an open end. In some embodiments, the closed end of the sleeve section includes at least one attachment point for connecting to exercise equipment, and the sleeve section further has an insert disposed between the closed end and the open end configured to maintain the open end in an open configuration to be gripped by a user.

In some embodiments, the sleeve section is a pant leg. In some embodiments, the closed end of the sleeve section includes reinforced stitching, which may support a weight of at least 150 pounds connected to the at least one attachment point. In some embodiments, the insert of the sleeve section is a foam insert. In some embodiments, each of the at least one attachment points is one of an eyelet, a grommet, or a strap loop, configured to attach to a connection point of exercise equipment. In some embodiments, the lapel section and the sleeve section each comprise a portion of a gi jacket.

Also disclosed is a method for exercising that includes the steps of providing a grip training system as described herein; and attaching at least the lapel section to exercise equipment by the at least one attachment point, gripping the collar of the lapel section and pulling with at least one arm in an arm path, wherein the arm path activates at least one muscle group.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
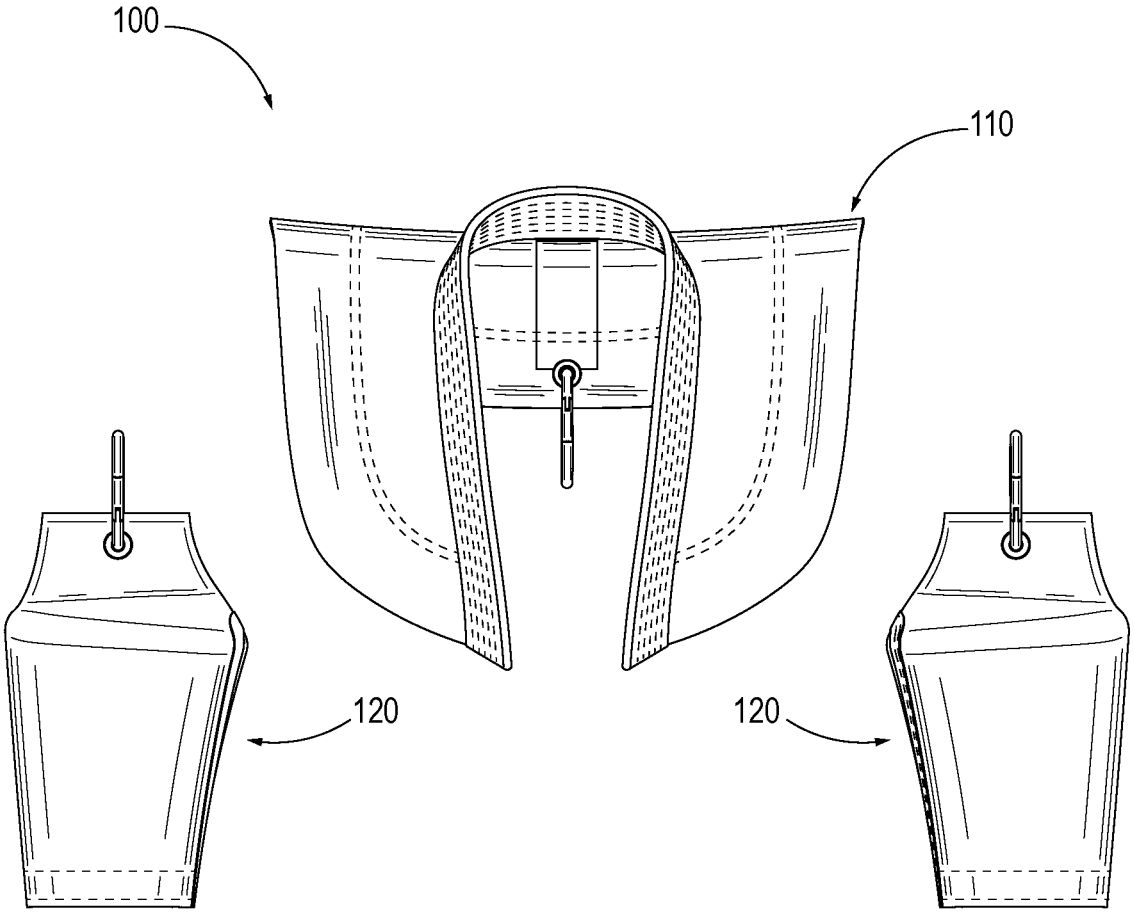
FIG. 1 illustrates an example grip training system.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

The present disclosure generally relates to grip training systems, and more particularly to grip training systems with application for martial arts sports. The grip training system may be used to train both grip strength, as well as, more general functional strength associated with various martial arts grip techniques. As described below, in various embodiments, the grip training system may more accurately recreate the environment of martial arts sports in order to train and improve the grip strength and techniques used in these activities.

Referring generally to FIGS. 1 through 11, embodiments of a grip training system 100 are illustrated. The grip training system may be formed, at least in part, from a fabric suitable to bear the forces imposed upon the system during use. In one example, the grip training system is formed from the same material, or type of material, used in a martial arts gi. In other embodiments, the grip training system may be formed from other sturdy fabrics, which in some cases may be further reinforced for the expected repetitive use in a training environment.

Moreover, the fabric used for a martial arts gi has a high coefficient of friction; and, therefore, is well suited to use in the grip training system. Moreover, the textured nature of the gi fabric provides a familiar feel to the user, and promotes use of a variety of different grips for a variety of different movements and ranges of motion. Because the relative position of the hands is not fixed when using the disclosed grip training system, the relative position of the hands may be adjusted when the system is loaded with weight. This freedom of motion may improve the user's mind-muscle connection, thereby improving hypertrophy and strength building capabilities.

FIG. 1 illustrates an embodiment of a grip training system 100. As shown, the grip training system 100 includes a lapel section 110 and at least one sleeve section 120. The lapel section 110 and each sleeve section 120 may be separate components, which together form a kit for training a variety of grips. The lapel section 110 and each sleeve section 120 may also be offered separately as desired. In one embodiment, the grip training system 100 includes two sleeve sections 120. The sleeve sections 120 may be the same or may be configured as different style sleeves, such as the arm sleeve of a gi jacket or the leg sleeve of gi pants, which may more commonly be referred to as a pant leg.

Figure 2:
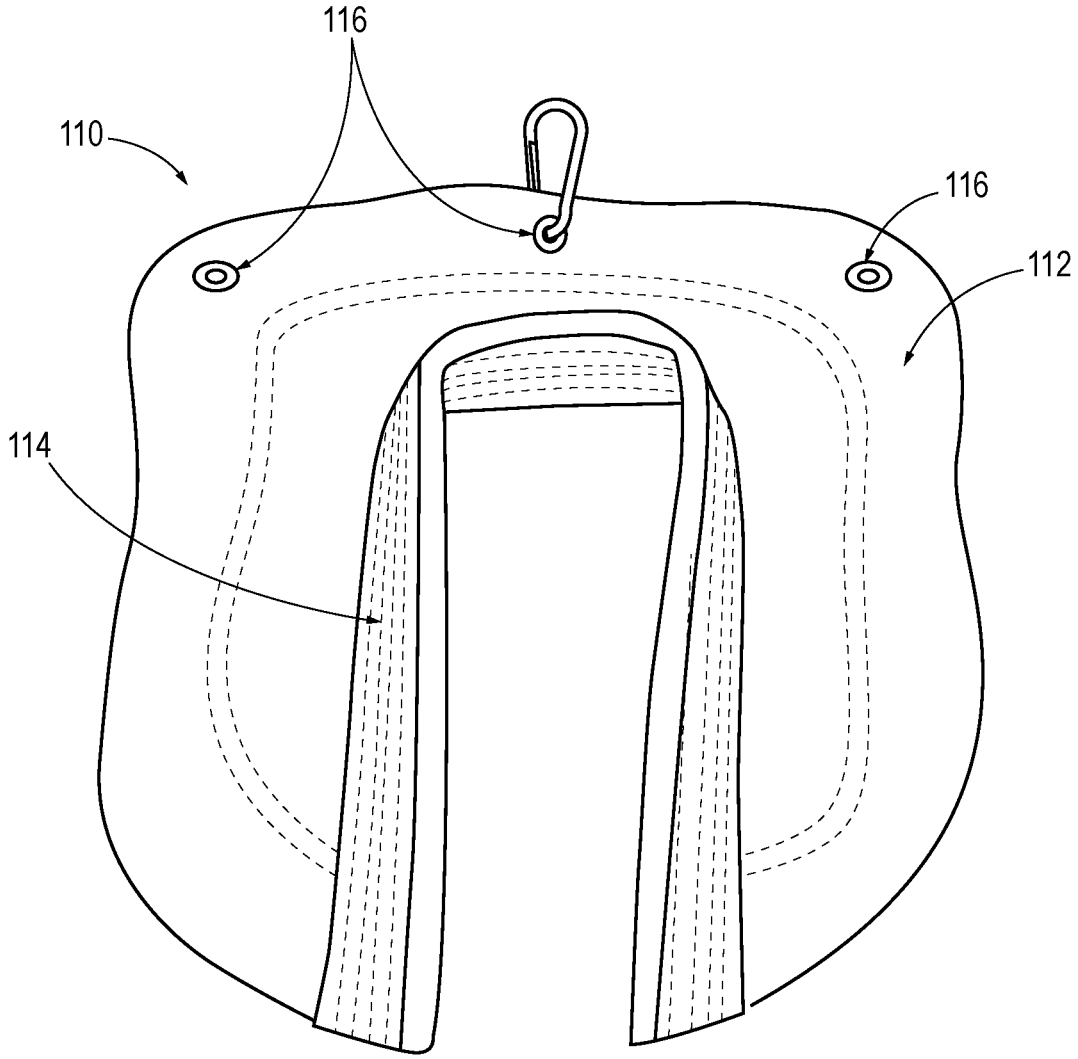
FIG. 2 illustrates a lapel section of an example grip training system.

FIG. 2 illustrates an embodiment of the lapel section 112 of the grip training system 100. The lapel section 110 includes an attachment section 112 and a collar section 114. The attachment section includes one or more attachment points 112, such as the three attachment points shown in FIG. 2. The attachment section enables the label section to be attached to exercise equipment, such as a cable machine by the attachment points.

In various embodiments, the attachment points 116 may include eyelets, such as shown in FIG. 2. In other embodiments, the attachment points may be grommets, strap loops, clips, or other means for attaching the lapel section 112 to a desired piece of exercise equipment or other device. During use of the grip training system 100, the attachment section 112 and the attachment points 116 are load-bearing sections, and thus may be designed to have a high tensile strength. In one example, the attachment section 112 may be reinforced such as by reinforced stitching or the use of fabric designed to bear the forces applied to the lapel section during use.

Referring again to FIG. 2, the lapel section 110 also includes a collar section 114. The collar 114 of the lapel section 110 reflects an actual gi collar, which is a common place for martial artists to grab in applied training environments. Similar to the collar of a gi, the collar section 114 is generally U-shaped configured to extend around a wearer's neck. In addition, the collar section 114 includes the portion forming lapels of the gi. In the grip training system 100, the collar section 114 of the lapel section 110 functions as a handle to be gripped by a user performing grip training exercises. In operation, the lapel section 110 is attached to exercise equipment, such as a cable machine, using one of the attachment points 116. By using various attachment points, and gripping the collar 114 at different locations, a variety of grips may be trained. In addition, the use of exercise equipment enables the use of various resistances, allowing a greater variety of training options than existed with prior grip training devices. In this manner, the grip training system may be used to train grips used in lapel submissions in Jiu Jitsu or throws in Judo.

Figure 3A:
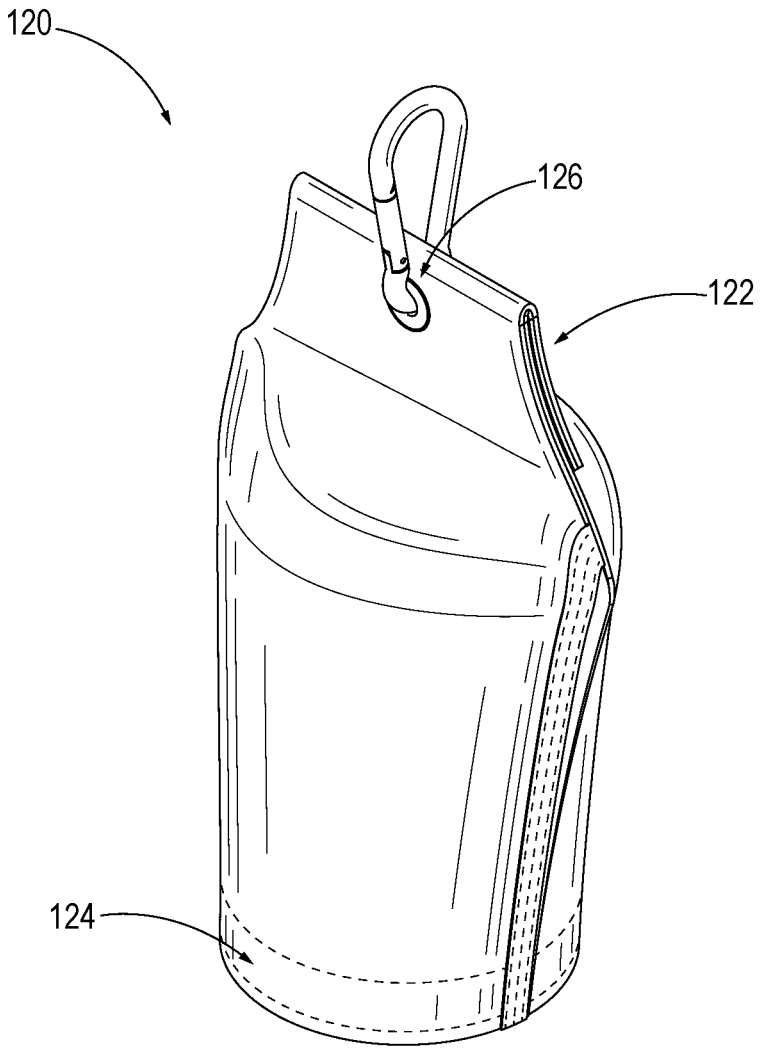
FIG. 3A is a front view of a sleeve section of an example grip training system.

FIG. 3A illustrates an embodiment of the sleeve section 120 of the grip training system 100. The sleeve section 120 has an attachment section that performs a similar function to the attachment section the lapel section. As shown in FIG. 3A, the attachment section of the sleeve section 120 is the closed end 122. In an embodiment, the closed end 122 is formed of overlapping fabric to provide a reinforcement to the attachment point 126. As discussed above, the attachment point 126 may be an eyelet strap loops, clips, or other means for attaching the sleeve section 120. The sleeve section 120 also has an open end 124. The open end 124 of the sleeve section 120 is configured to represent the cuff of a sleeve.

In one example of grip training, a user may grip the open end 124 of sleeve section 120 in the same manner as a marital artist would grip the cuff of an arm sleeve or pant leg, both of which are common grappling points in sports like Brazilian Jiu Jitsu or Judo. In other examples, the user may grip the side of the sleeve section 120, or any portion of the sleeve section 120 to perform a grip training exercise. In each case, the sleeve section 120 functions as a handle for the grip training exercise providing a more accurate recreation of the environment of martial arts sports for grip training.

In various embodiments, the sleeve section 120 may be an arm sleeve or a pant leg as discussed above, and multiple sleeve sections 120 may be used at the same time, with or without a lapel section 110. In some embodiments, two sleeve sections, representing a pair of pant legs, may be attached to a double cable machine to train grips for the Toreando pass used in Jiu Jitsu. In another embodiment, one sleeve section may be attached to a cable rowing machine for repetitive grip training. In yet another embodiment, two sleeve sections may be attached to each end of an exercise band. The user may then place his feet in the band and grip each sleeve section with one hand to train grips for the spider guard.

Figure 3B:
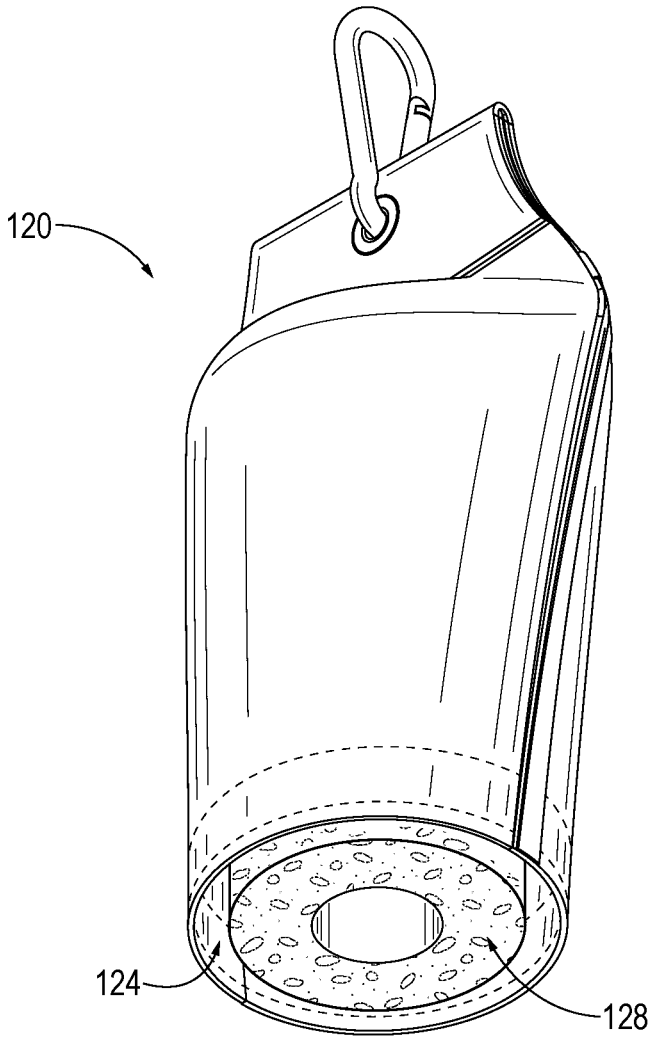
FIG. 3B is a bottom perspective view of a sleeve section of an example grip training system.
Figure 4:
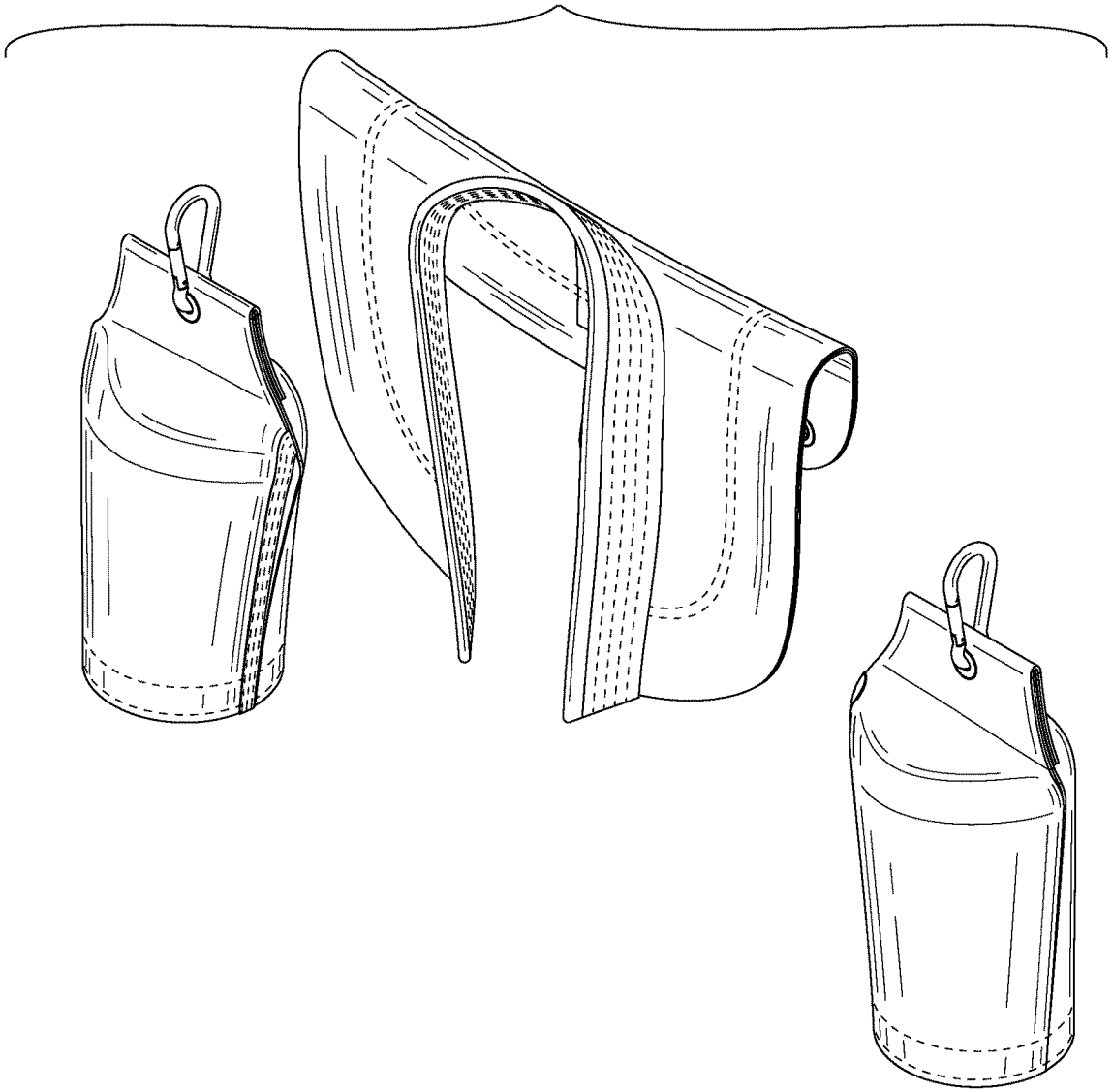
FIG. 4 is a top front right side perspective view of an example grip training system.
Figure 5:
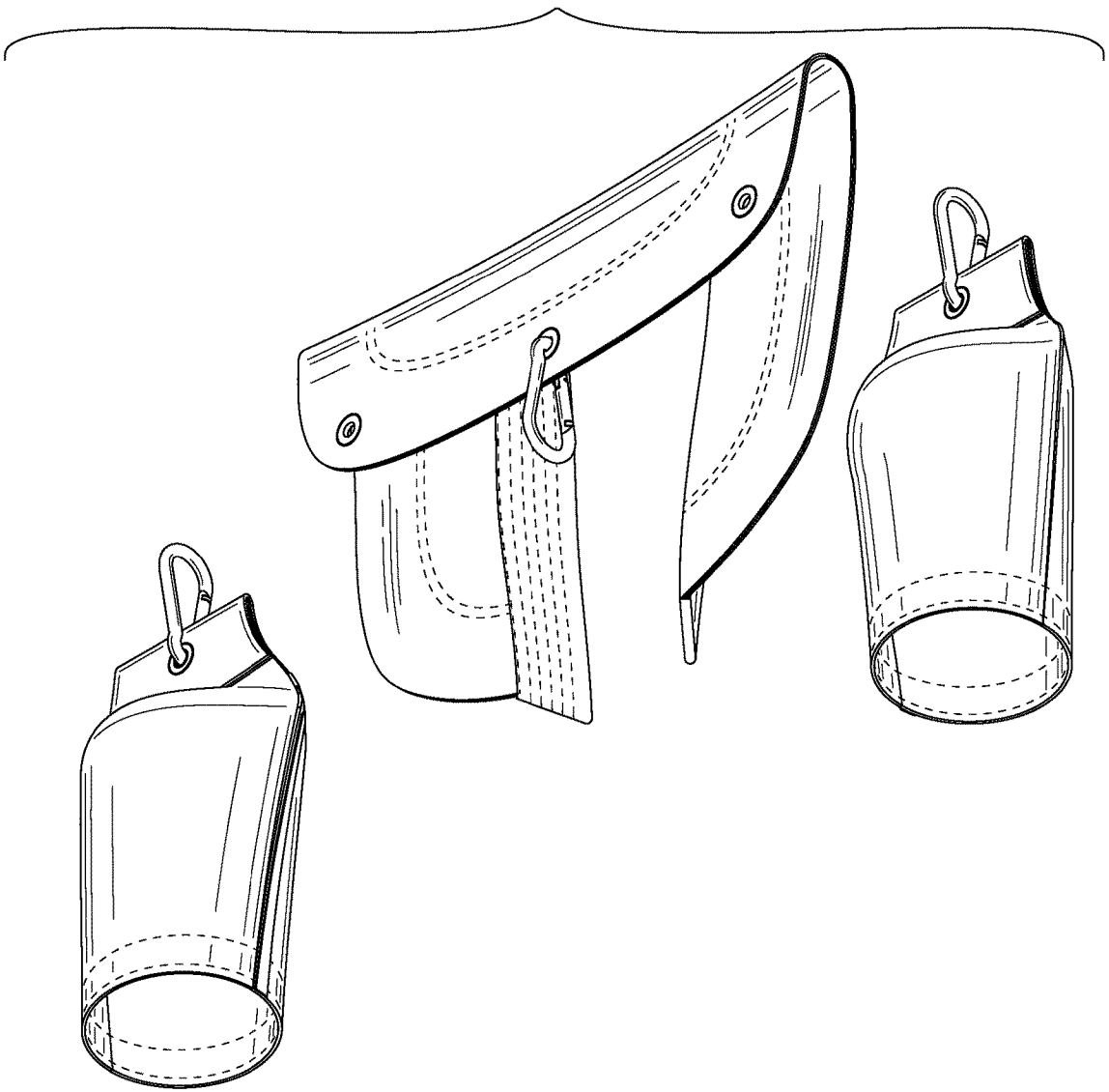
FIG. 5 is a top rear left side perspective view of an example grip training system.
Figure 6:
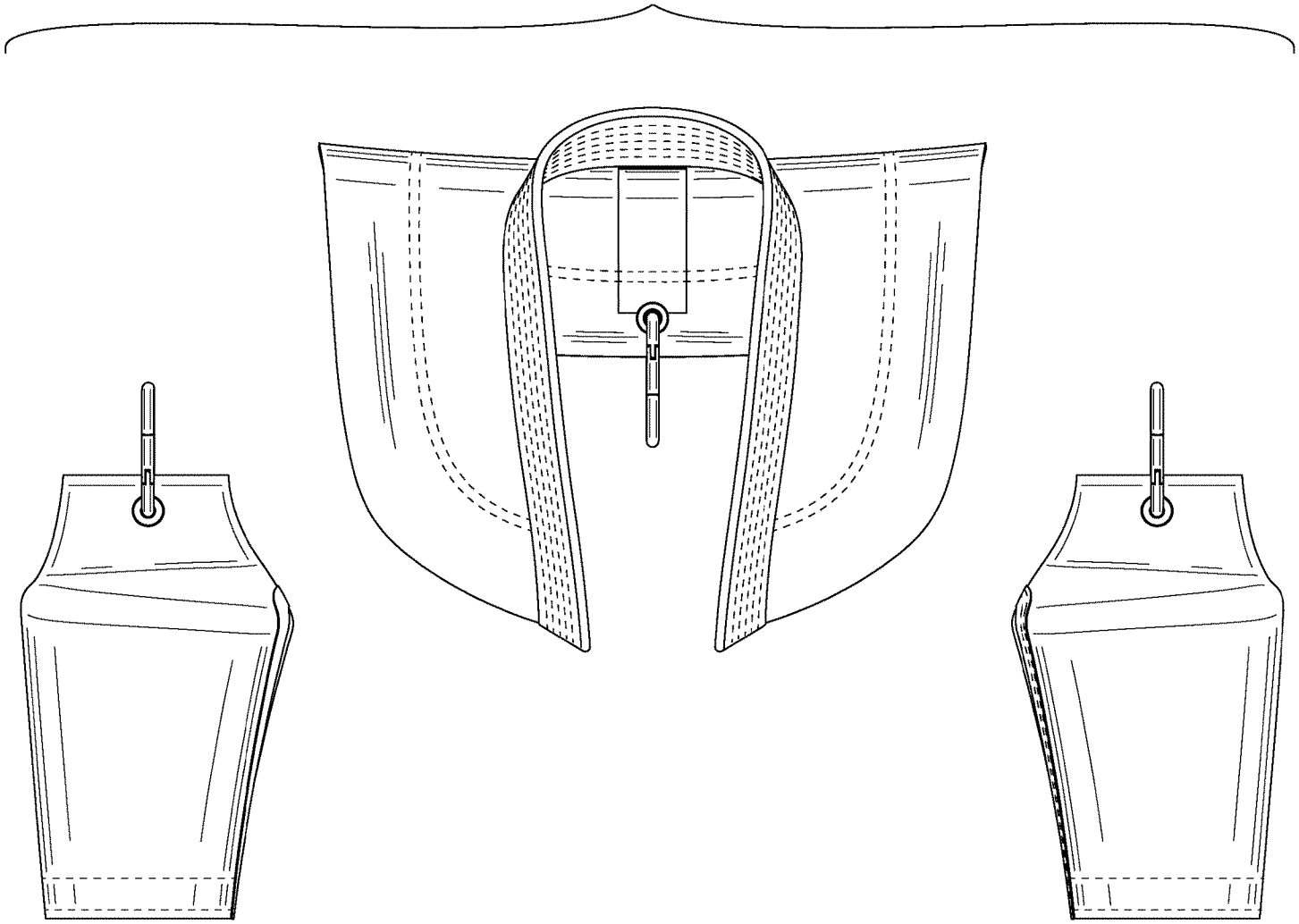
FIG. 6 is a front view of an example grip training system.
Figure 7:
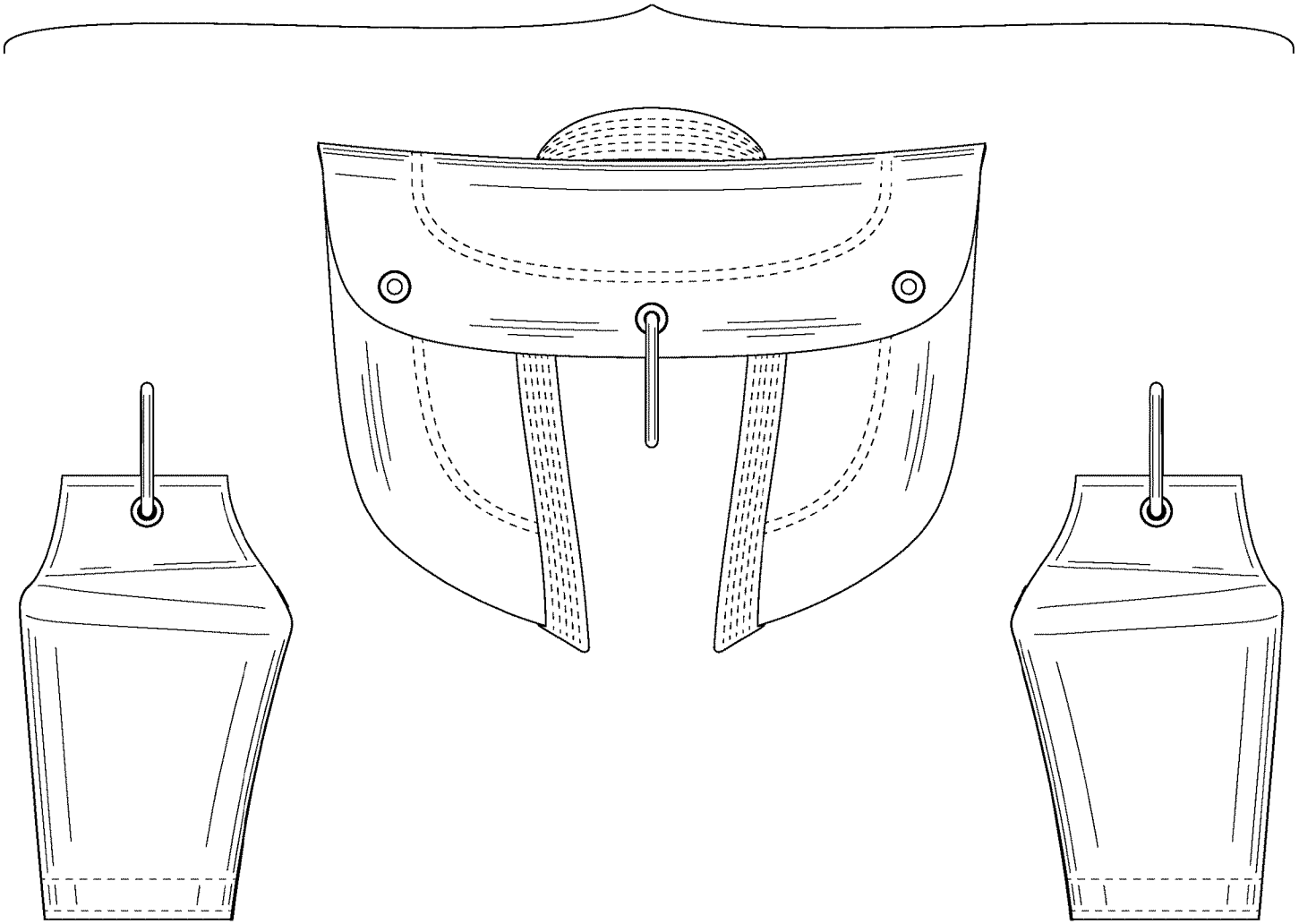
FIG. 7 is a back view of an example grip training system.
Figure 9:
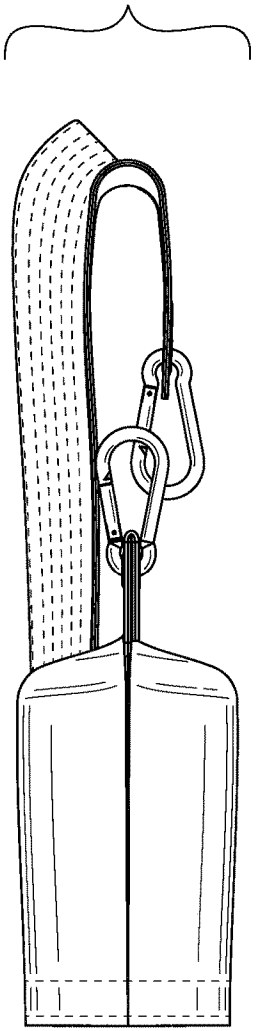
FIG. 9 is a right view of an example grip training system.
Figure 8:
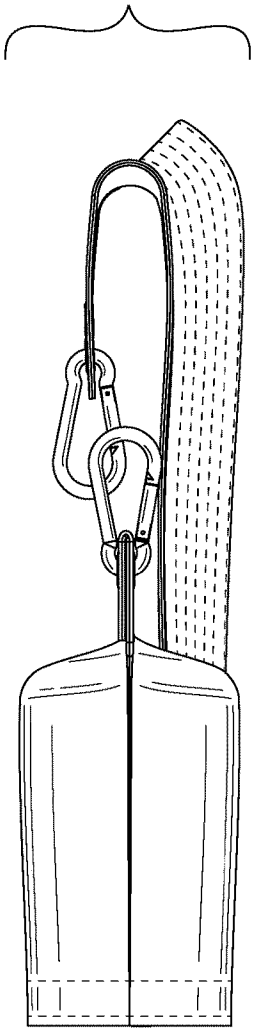
FIG. 8 is a left view of an example grip training system.
Figure 10:
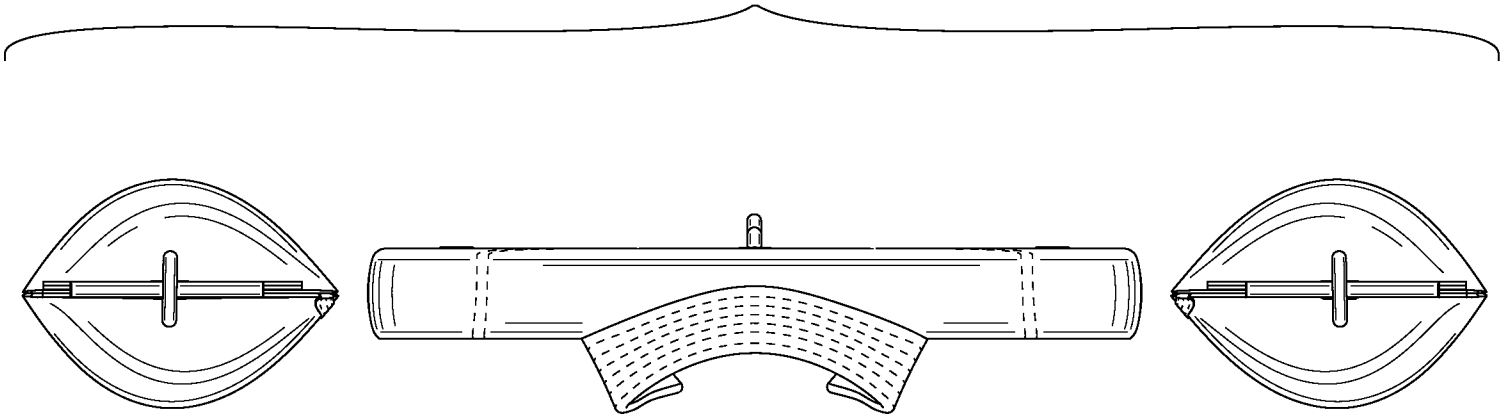
FIG. 10 is a top view of an example grip training system.
Figure 11:
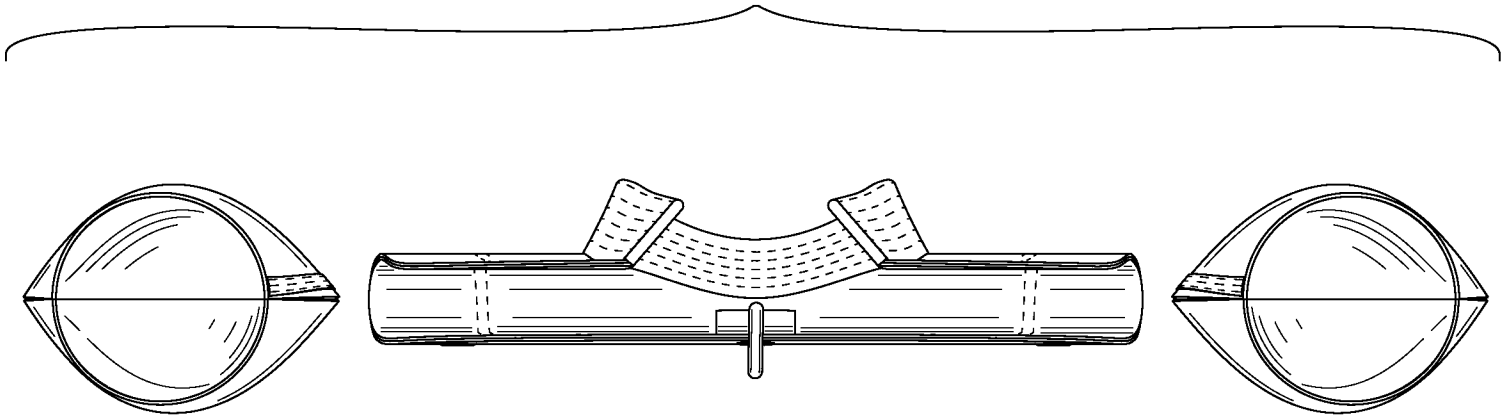
FIG. 11 is a bottom view of an example grip training system.

FIG. 3B illustrates the open end 124 of the sleeve section 120. As shown, the sleeve section 120 includes an insert 128. In one embodiment, the insert is made of foam, which may be tubular foam, or other lightweight but sturdy material. The insert 128 maintains the sleeve section 120 in an open configuration during use, in the same manner that an arm or leg would hold open the sleeve of a gi jacket or gi pants. In some embodiments, the insert 128 may be secured within the sleeve section, such as by attaching the insert to the inside of the closed end 122. In other embodiments, the insert 128 is freely removable from the sleeve section. In addition, the insert may be disposed generally between the closed end and the open end, but may extend out of the sleeve section.

With the insert 128 inside the sleeve section, a user is able to engage with the sleeve section in the same or a similar manner as they would during an actual grappling experience with another user. By maintaining an open configuration of the sleeve section 120, the insert 128 offers users a choice between grabbing onto the peripheral fabric of the sleeve section 120 and grabbing onto the whole portion, as one might grab onto an arm or leg covered by a sleeve. The insert 128 therefore offers increased variability in training that more accurately simulates an authentic grappling experience.

Also disclosed is a method of grip training. In various embodiments, a method of grip training includes attaching at least one of a lapel section or a sleeve section of a grip training system to exercise equipment using attachment points of the grip training system. The attachment points may be connected to the exercise equipment with clips, straps, carabineers, or other connectors based upon the type of equipment selected. The method further includes gripping the grip training system, such as by the collar of the lapel section or the open end of the sleeve section, and pulling to activate the user's muscles thereby training and strengthening the user's grip.

In some embodiments, users may attach the lapel section 110 and/or the sleeve section 120 to cable operated strength training equipment, such as a cable pulldown machine, a cable row machine, or other functional trainer. Then the user can select a weight or resistance, against which they can grip lapel section 110 or sleeve section 120, in the same manner as they would if sparring in a martial art. The user may then perform multiple repetitions of the movement to improve the grip strength and technique, and may increase the weight or resistance as the user improves.

In other embodiments, lapel section 110 and sleeve section 120 be attached to dumbbells or heavy objects. The section 110, 120 can also be used with exercise bands attached to a pole or anchored in some other way known in the art.

FIGS. 4-11 further illustrate the design and configuration of an example grip training system according to the present disclosure.

The presently disclosed grip training system may provide benefits including more accurately recreating the environment of martial arts sports in order to train and improve the grip strength and techniques. The conventional grip training devices fail to simulate the specific grips required in martial arts, focusing instead on repetitive use of the muscles in the hands and particularly the forearms. The presently disclosed grip training system however allows a user to build functional strength using the grips consistent with their chosen activity. These aspects of the system may help users to build muscle memory with different grips that mimic functional gi grips in a manner not possible with convention grip training devices. Therefore, users who train by applying force to workout equipment through the hands and grips using the disclosed grip training system may gain an advantage in grappling settings.

One or more illustrative embodiments incorporating aspects of the invention are disclosed herein. Not all features of a physical implementation are described or shown in this application for the sake of clarity. It is understood that in the development of a physical embodiment incorporating the embodiments of the present invention, numerous implementation-specific decisions are to be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

What is claimed is:

1. A grip training system, comprising a lapel section having a collar section and an attachment section with at least one attachment point for connecting to exercise equipment, and a sleeve section having a closed end and an open end, wherein the closed end of the sleeve section includes at least one attachment point for connecting to the exercise equipment, and wherein the sleeve section further has an insert disposed between the closed end and the open end configured to maintain the open end in an open configuration to be gripped by a user.

2. The grip training system of claim 1, wherein the sleeve section is a pant leg.

3. The grip training system of claim 1, wherein the closed end of the sleeve section includes reinforced stitching.

4. The grip training system of claim 1, wherein the closed end of the sleeve section includes reinforced stitching to support a weight of at least 150 pounds connected to the at least one attachment point.

5. The grip training system of claim 1, wherein the insert of the sleeve section is a foam insert.

6. The grip training system of claim 1, wherein each of the at least one attachment points is an eyelet configured to attach to a connection point of exercise equipment.

7. The grip training system of claim 1, wherein each of the at least one attachment points is a grommet.

8. The grip training system of claim 1, wherein each of the at least one attachment points is a strap loop.

9. The grip training system of claim 1, wherein each of the at least one attachment points is one of an eyelet, a grommet, or a strap loop, configured to attach to a connection point of exercise equipment.

10. The grip training system of claim 1, wherein the lapel section and the sleeve section each comprise a portion of a gi jacket.

11. A method for exercising, comprising the steps of providing the grip training system of claim 1;

attaching at least the lapel section to the exercise equipment by the at least one attachment point, gripping the collar of the lapel section and pulling with at least one arm in an arm path, wherein the arm path activates at least one muscle group.

* * * * *